US012398635B2

(12) United States Patent
Travis et al.

(10) Patent No.: US 12,398,635 B2
(45) **Date of Patent: *Aug. 26, 2025**

(54) HYDRAULIC FRACTURING FLUID DELIVERING SYSTEM

(71) Applicants: Todd Anthony Travis, Humble, TX (US); Angelica Calzoncinth, Baytown, TX (US); Eric Calzoncinth, Baytown, TX (US)

(72) Inventors: Todd Anthony Travis, Humble, TX (US); Angelica Calzoncinth, Baytown, TX (US); Eric Calzoncinth, Baytown, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/767,897

(22) Filed: Jul. 9, 2024

(65) Prior Publication Data

US 2024/0360748 A1 Oct. 31, 2024

Related U.S. Application Data

(63) Continuation-in-part of application No. 17/538,859, filed on Nov. 30, 2021, now Pat. No. 12,031,419.

(60) Provisional application No. 63/180,000, filed on Apr. 26, 2021.

(51) Int. Cl.

| | |
|---|---|
| ***E21B 43/26*** | (2006.01) |
| ***F04B 15/02*** | (2006.01) |
| ***F04B 23/02*** | (2006.01) |

(52) U.S. Cl.

CPC ..... *E21B 43/2607* (2020.05)

(58) Field of Classification Search

CPC ..... E21B 43/2607; E21B 43/26; F04B 15/02; F04B 23/02; F04B 37/12; F04B 43/08; F04B 53/00; F04B 53/22; F16L 41/02

USPC ..... 166/308.1

See application file for complete search history.

(56) References Cited

U.S. PATENT DOCUMENTS

| | | | | |
|---|---|---|---|---|
| 11,085,266 | B2 * | 8/2021 | Thomeer | E21B 17/02 |
| 11,359,474 | B1 * | 6/2022 | Uhlmer | E21B 43/2607 |
| 11,536,407 | B2 * | 12/2022 | Riedel, Jr. | F16L 41/03 |
| 12,031,419 | B2 * | 7/2024 | Travis | E21B 43/2607 |
| 2015/0000766 | A1 * | 1/2015 | Arizpe | F16F 7/14 137/561 A |
| 2017/0122060 | A1 * | 5/2017 | Dille | E21B 43/2607 |
| 2017/0159654 | A1 | 6/2017 | Kendrick | |
| 2017/0370199 | A1 * | 12/2017 | Witkowski | F04B 15/02 |

(Continued)

*Primary Examiner* — Nicole Coy
*Assistant Examiner* — Douglas S Wood

(57) ABSTRACT

A hydraulic fracturing fluid delivering system includes at least one fracturing fluid delivering unit that is configured with a low-pressure flow line assembly, a high-pressure flow line assembly, a plurality of cross beams, and at least one isolation valve. The plurality of cross beams is evenly spaced along the low-pressure flow line assembly. The plurality of cross beams is welded onto the low-pressure flow line assembly to structurally strengthen the fracturing fluid delivering unit. The high-pressure flow line assembly is positioned atop the plurality of cross beams and mounted to the plurality of cross beams so that the multiple high-pressure flow line assemblies are able to structurally strengthen the hydraulic fracturing fluid delivering system. A pair of pipes for the low-pressure flow line assembly are in selective fluid communication with each other through the at least one isolation valve in order to control fluid flow between the pair of pipes.

16 Claims, 17 Drawing Sheets

(56) References Cited

U.S. PATENT DOCUMENTS

| | | | | |
|---|---|---|---|---|
| 2018/0187622 | A1 | 7/2018 | Rudolecky et al. | |
| 2019/0383125 | A1* | 12/2019 | Koricanek | E21B 43/2607 |
| 2022/0341304 | A1* | 10/2022 | Travis | E21B 43/2607 |
| 2022/0349345 | A1* | 11/2022 | Zhang | F02C 3/22 |
| 2023/0107300 | A1* | 4/2023 | Huang | F17D 3/01 137/597 |
| 2025/0084745 | A1* | 3/2025 | Ripple | E21B 43/2607 |

* cited by examiner

HYDRAULIC FRACTURING FLUID DELIVERING SYSTEM

The current application is a continuation-in-part (CIP) application of the U.S. non-provisional application Ser. No. 17/538,859 filed on Nov. 30, 2021. The U.S. non-provisional application Ser. No. 17/538,859 claims a priority to the U.S. Provisional Patent application Ser. No. 63/180,000 filed on Apr. 26, 2021.

FIELD OF THE INVENTION

The present invention is generally related to hydraulic manifold systems in the technical field of fracturing fluid delivery technology. More specifically, the present invention is a hydraulic fracturing fluid delivering system that improves upon typical traditional trailer and skid missile systems.

BACKGROUND OF THE INVENTION

Typically, monoline missile systems in the technical field of fracturing fluid delivery technology include three main sub-assemblies. The two main sub-assemblies are a low-pressure manifold system and a high-pressure manifold system. The low-pressure manifold system and the high-pressure manifold system are both designed to increase the pressure from the low-pressure manifold system to the high-pressure manifold system to the header input fluid pressure via series of pumps. The third sub-assembly is a skid sub-assembly. The three sub-assemblies are designed such that the skid sub-assembly maintains structural integrity and stability for the entire monoline missile system.

However, an objective of the present invention is to reduce or eliminate the skid sub-assemblies involved in the existing monoline missile system. Another objective of the present invention is to provide an integrated and skid-less compact design for monoline missile systems. The present invention reduces the number of sub-assemblies that are traditionally required for a more cost-effective configuration, as well as an increase in productivity. More specifically, a low-pressure assembly of the present invention becomes a structural body so that each fracturing fluid delivering unit can be configured using two sub-assemblies rather than three sub-assemblies. A high-pressure assembly of the present invention can function as a structural body on its own or in conjunction with the low-pressure sub assembly between multiple fracturing fluid delivering units so that the present invention can be operational. The present invention eliminates the structural skid sub-assembly thus reducing manufacturing cost and the total weight.

DETAILED DESCRIPTION OF THE INVENTION

All illustrations of the drawings are for the purpose of describing selected versions of the present invention and are not intended to limit the scope of the present invention.

The present invention is a hydraulic fracturing fluid delivering system that is described as a compact integrated monoline system similar to an existing monoline system (i.e., known as a monoline system). Existing monoline systems typically include three main sub-assemblies. A skid sub-assembly is intended to function as the structural body to support the weight of the other two sub-assemblies, which are a low-pressure sub-assembly and a high-pressure sub-assembly. Both the low-pressure sub-assembly and the high-pressure sub-assembly work together to move fluid supplied through the pressurization process. The existing monoline systems are well known and utilized in this industry. Therefore, the present invention is able to focus on a new structural configuration to deliver the fracturing fluid delivery without the skid sub-assembly, which results in a lighter and more cost-effective hydraulic fracturing fluid delivering system. More specifically, the present invention only utilizes the low-pressure sub-assembly and the high-pressure sub-assembly to move fluid supplied through the pressurization process but does not contain the skid sub-assembly that is present within existing monoline systems.

Figure 1:
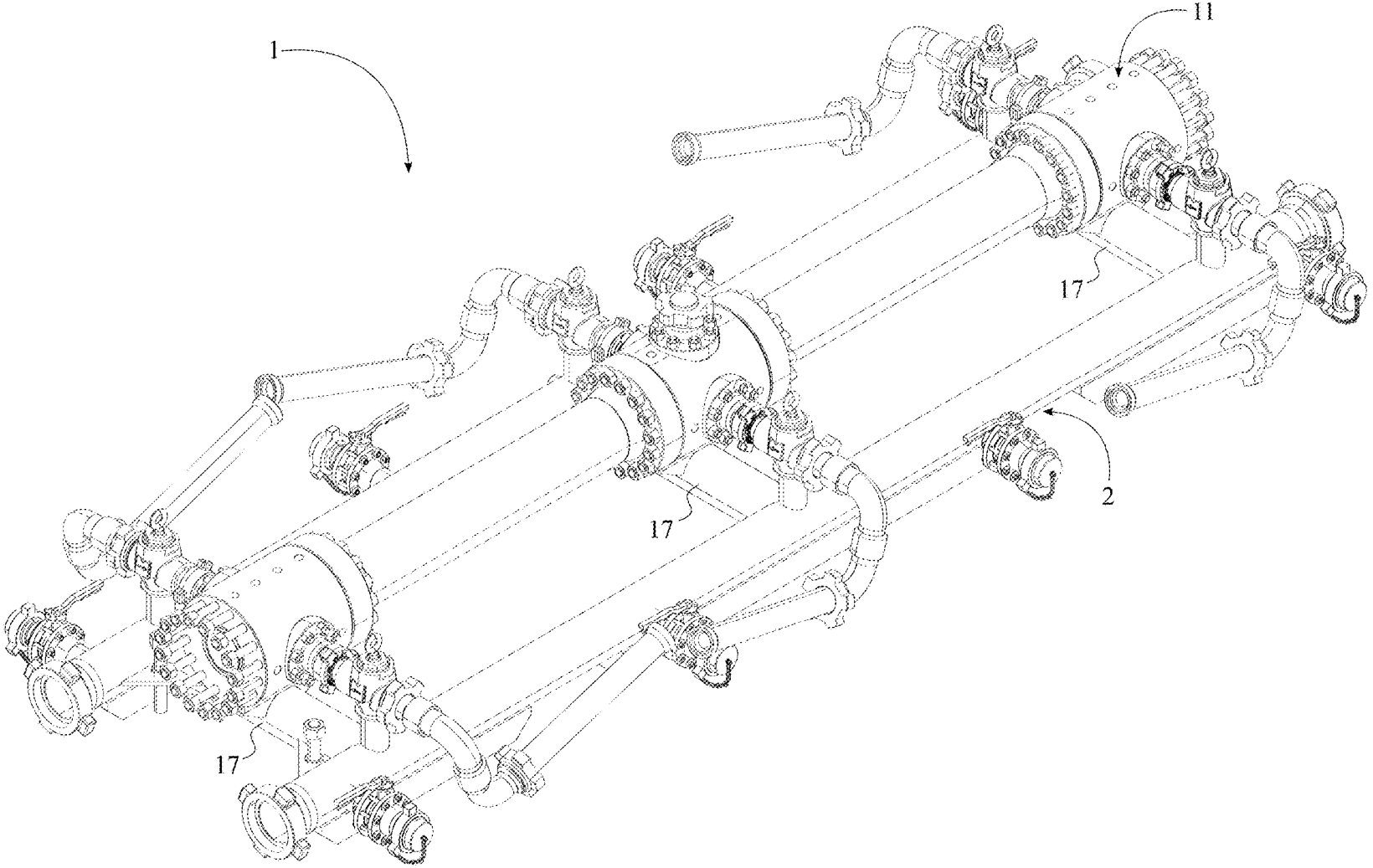
FIG. 1 is a top perspective view of a fracturing fluid delivering unit.
Figure 2:
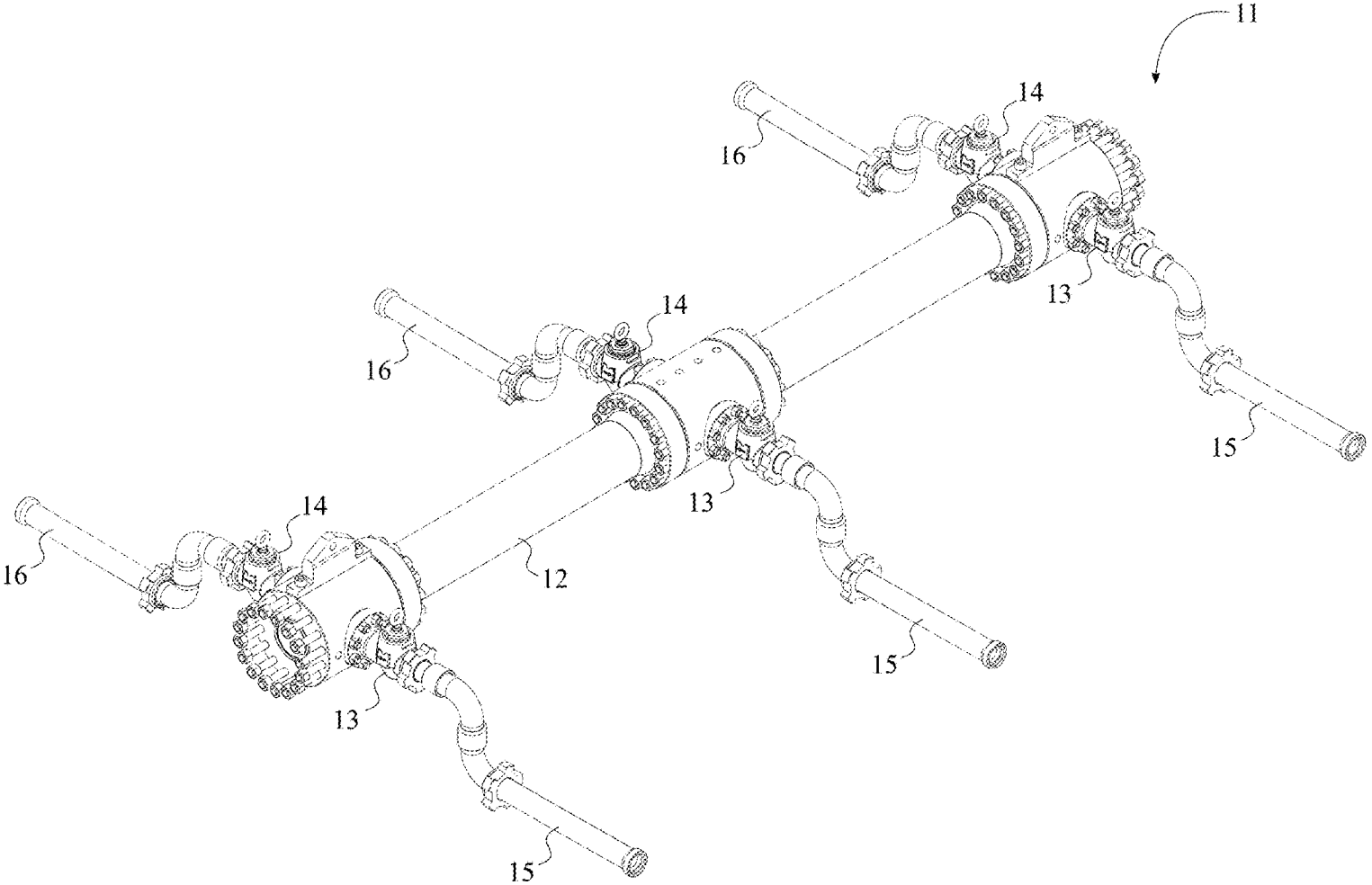
FIG. 2 is a top perspective view showing the high-pressure flow line assembly for the fracturing fluid delivering unit.
Figure 3:
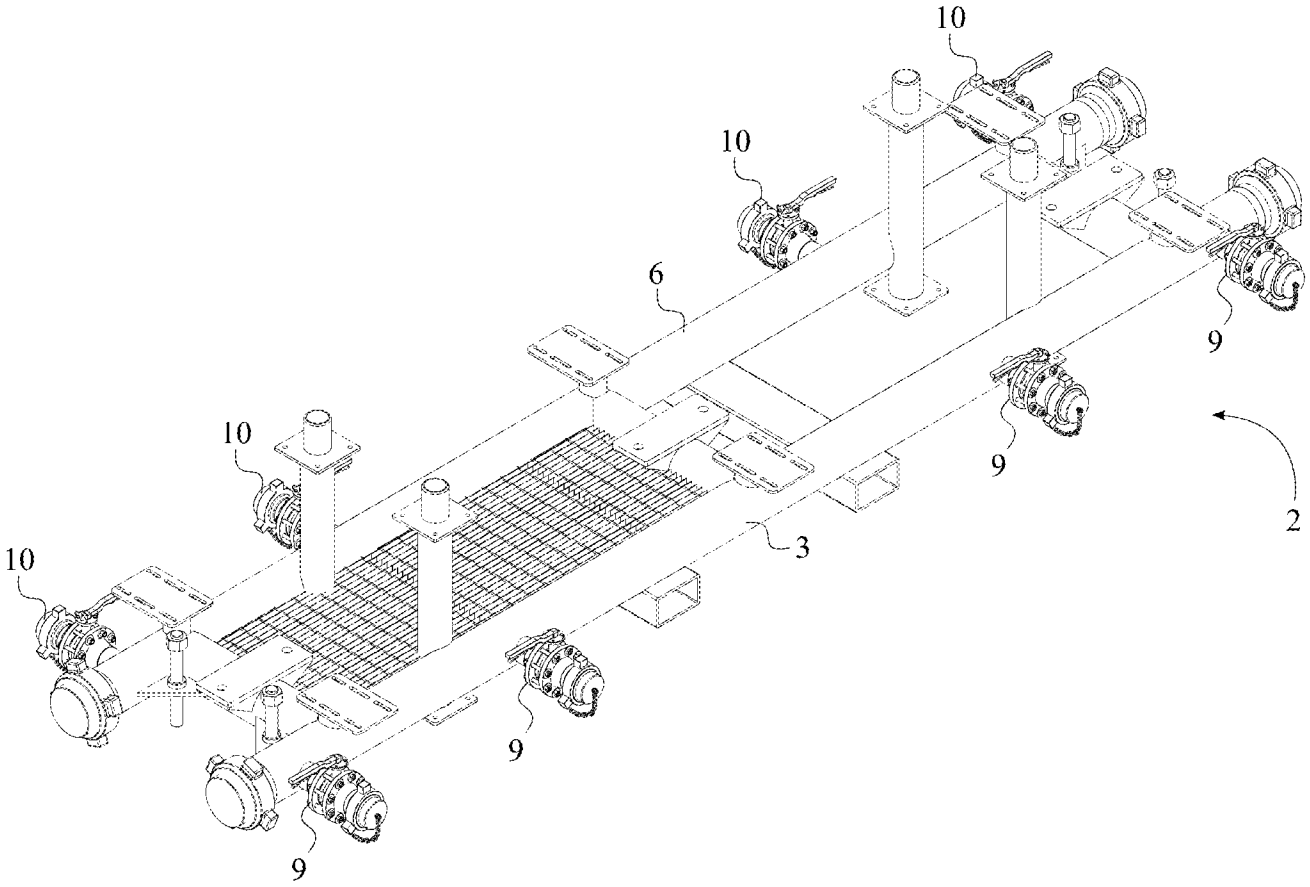
FIG. 3 is a top perspective view showing the low-pressure flow line assembly for the fracturing fluid delivering unit.

The present invention is explained in relation to at least one fracturing fluid delivering unit 1 that comprises a low-pressure flow line assembly 2, a high-pressure flow line assembly 11, a plurality of cross beams 17, and at least one isolation valve 18 as shown in FIG. 1. In reference to the general configuration of the present invention, the plurality of cross beams 17 is evenly spaced along the low-pressure flow line assembly 2 so that the plurality of cross beams 17 can be preferably welded onto the low-pressure flow line assembly 2. Alternatively, the plurality of cross beams 17 may also be bolted onto the low-pressure flow line assembly 2. Due to the multiple welded connections between the low-pressure flow line assembly 2 and the plurality of cross beams 17, the low-pressure flow line assembly 2 becomes the structural body for the present invention. Structural elements of the existing monoline systems, such as skids, sleds, I-beams, and other supporting members, are eliminated from the present invention thus reducing the manufacturing cost and the total weight. The high-pressure flow line assembly 11 is positioned atop the plurality of cross beams 17 so that the high-pressure flow line can be mounted to the plurality of cross beams 17. The low-pressure flow line assembly 2 facilitates the movement of the hydraulic fracturing fluid from a storage tank to multiple pump trucks so that the hydraulic fracturing fluid can be pressurized. Once the hydraulic fracturing fluid is pressurized via the pump trucks, the pressurized hydraulic fracturing fluid is then discharged into the high-pressure flow line assembly 11 so that the pressurized hydraulic fracturing fluid can be injected into the wellhead to initiate the hydraulic fracturing.

As can be seen in FIGS. 14 through 17, a drilling operation pumps a clean fluid into a bore until the shale starts to crack open, and the drilling operation then pumps a dirty fluid into the bore in order to fill us these cracks with fracking sand, which keeps those cracks open and allows oil and gas to flow through those cracks. Thus, the low-pressure flow line assembly 2 comprises a left pipe 3 and a right pipe 6, which are mounted parallel and offset from each other. One pipe (i.e., the left pipe 3 or the right pipe 6) carries a clean fluid (e.g., just water), while the other pipe carries a dirty fluid (e.g., fracking sand, chemicals, or some mixture thereof). The left pipe 3 and the right pipe 6 are in selective fluid communication with each other through the at least one isolation valve 18, which allows a fluid flow between the left pipe 3 and the right pipe 6 but also allows the at least one isolation valve 18 to readily halt the fluid flow being the left pipe 3 and the right pipe 6.

The low-pressure flow line assembly 2 moves the hydraulic fracturing fluid from the storage tank to the multiple pump trucks so that the hydraulic fracturing fluid can be pressurized. In reference to FIGS. 3 through 7, the low-pressure flow line assembly 2 may further comprise a plurality of left outlets 9 and a plurality of right outlets 10. More specifically, the plurality of cross beams 17 is positioned parallel and offset from each other to evenly distribute the weight of the high-pressure flow line assembly 11 and to structurally strengthen the left pipe 3 onto the right pipe 6. The left pipe 3 is positioned perpendicular to the plurality of cross beams 17 so that the left pipe 3 can be terminally welded (or bolted) onto each of the plurality of cross beams 17. The right pipe 6 is positioned perpendicular to the plurality of cross beams 17 so that the right pipe 6 can be terminally welded (or bolted) onto each of the plurality of cross beams 17, opposite of the left pipe 3. In order to pressurize the hydraulic fracturing fluid, a first set of pump trucks is positioned adjacent to the left pipe 3, and a second set of pump trucks is positioned adjacent to the right pipe 6. As a result, the left pipe 3 enables the hydraulic fracturing fluid to move from the storage tank to the first set of pump trucks. More specifically, the plurality of left outlets 9 is integrated into the left pipe 3 and is in fluid communication with the left pipe 3 so that the first set of pump trucks can be coupled to the left pipe 3 via the plurality of left outlets 9. Similarly, the right pipe 6 enables the hydraulic fracturing fluid to move from the storage tank to the second set of pump trucks. More specifically, the plurality of right outlets 10 is integrated into the right pipe 6 and is in fluid communication with the right pipe 6 so that the second set of pump trucks can be coupled to the right pipe 6 via the plurality of right outlets 10.

Figure 4:
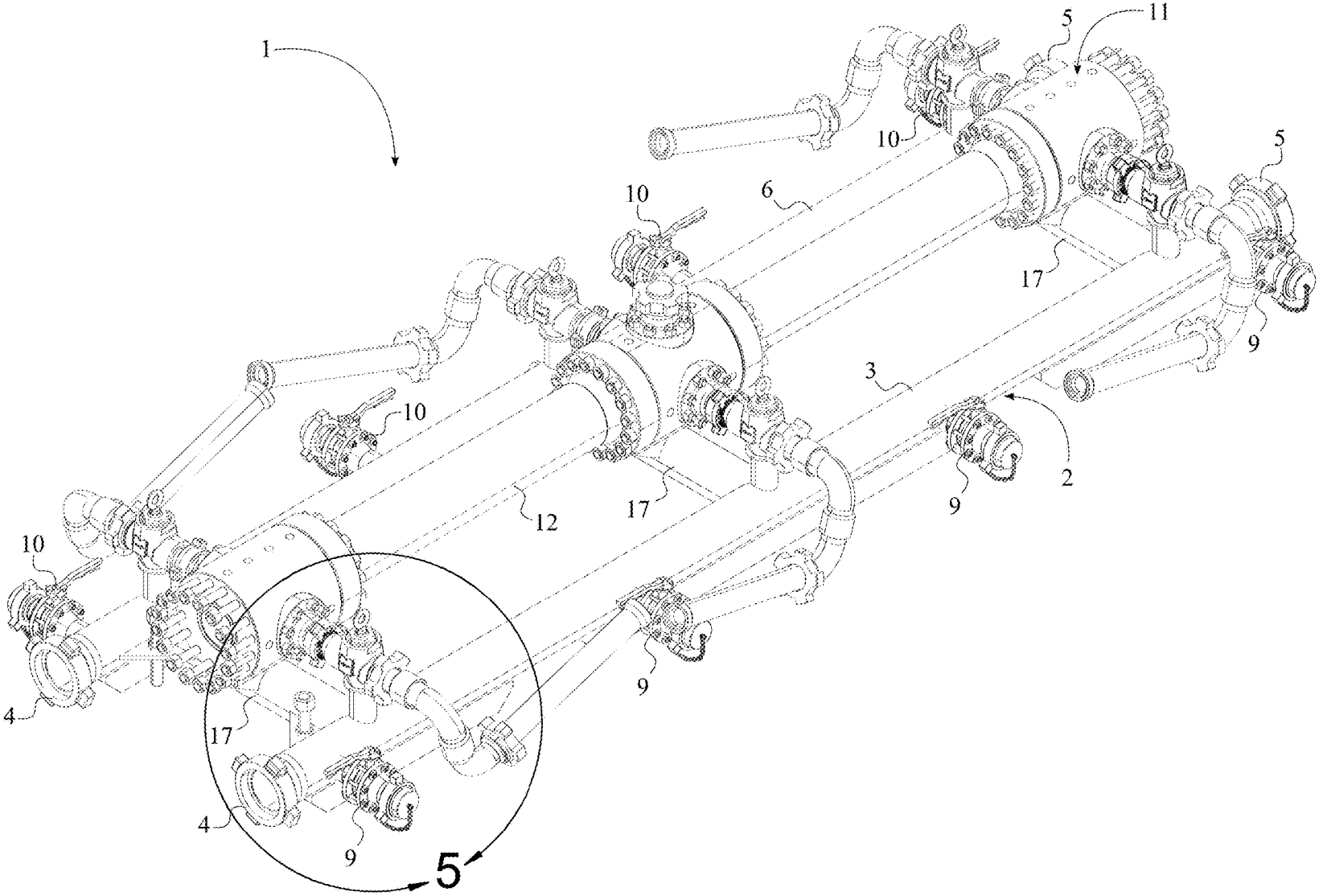
FIG. 4 is a top-left perspective view being used to reference an end section of the fracturing fluid delivering unit.
Figure 5:
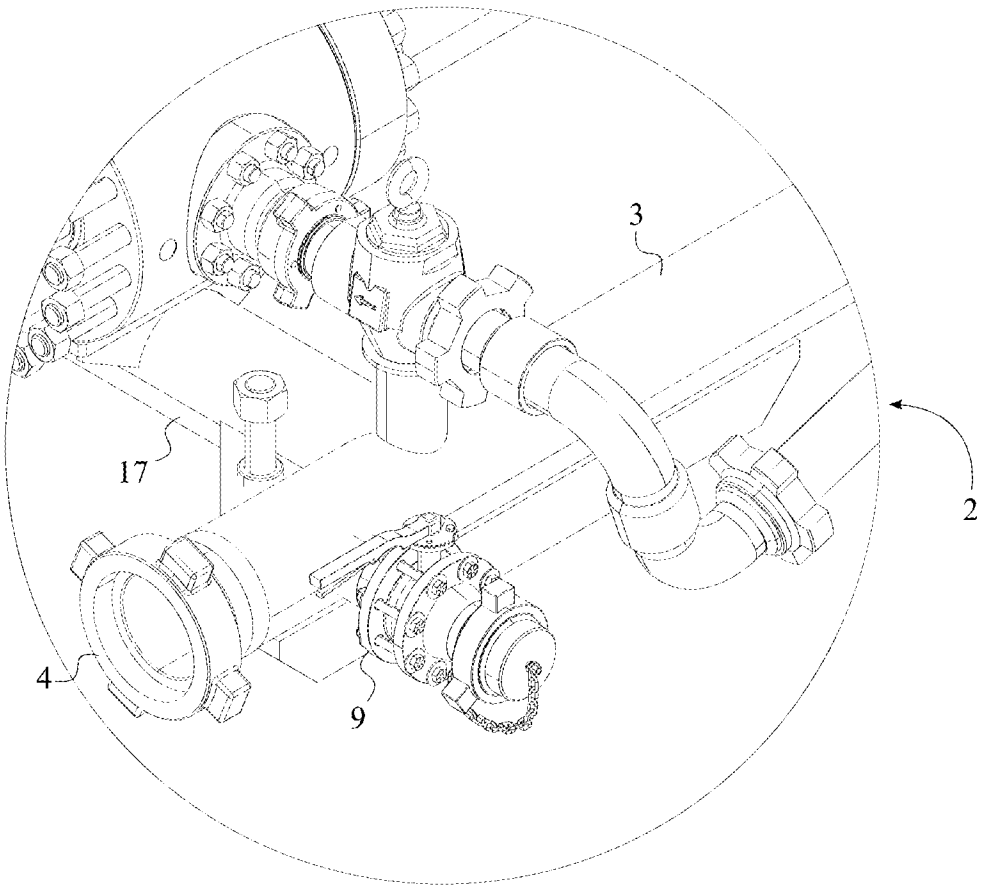
FIG. 5 is a detailed view taken about circle 5 in FIG. 4 showing the left pipe for the fracturing fluid delivering unit.
Figure 6:
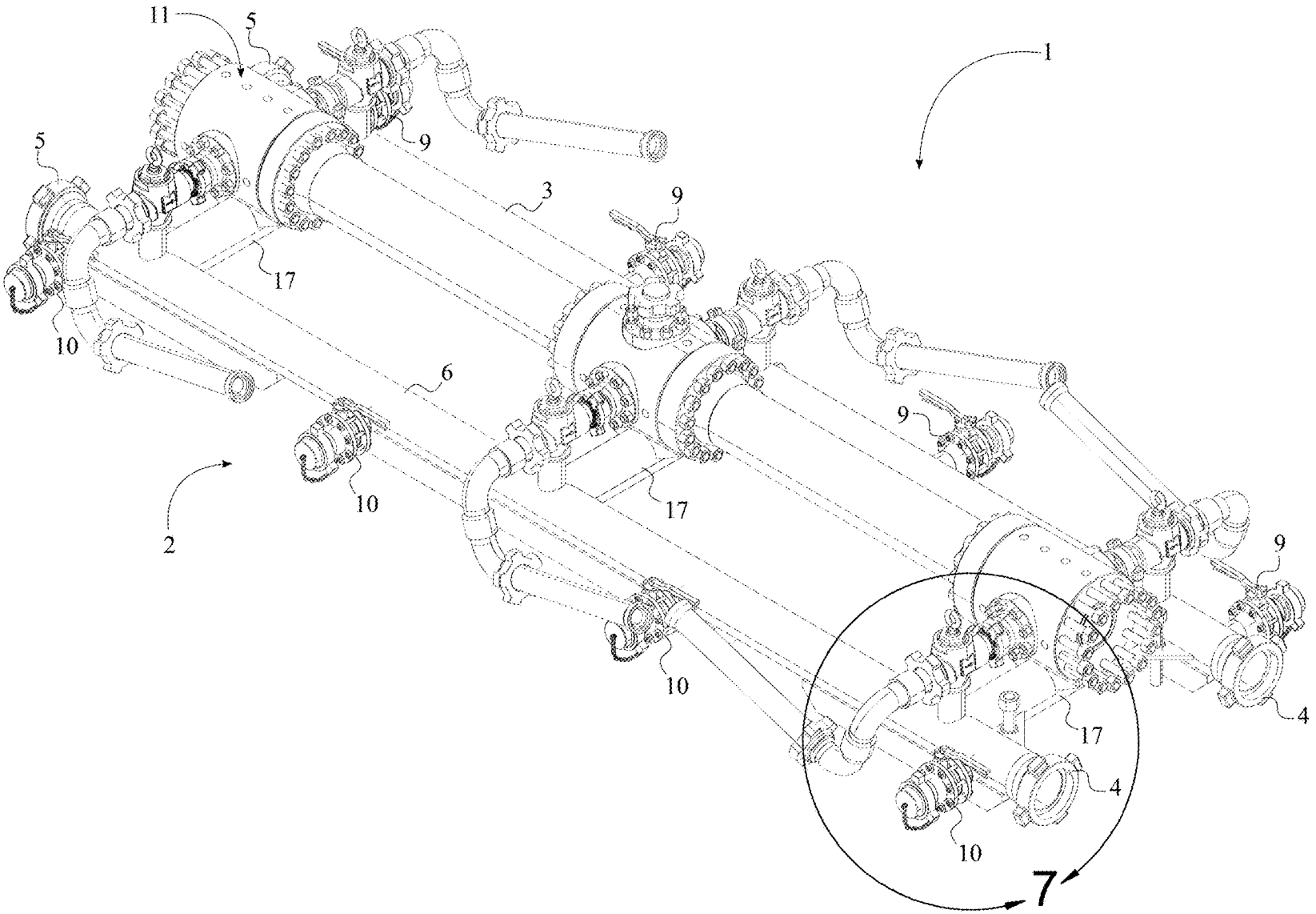
FIG. 6 is a top-right perspective view being used to reference another end section of the fracturing fluid delivering unit.
Figure 7:
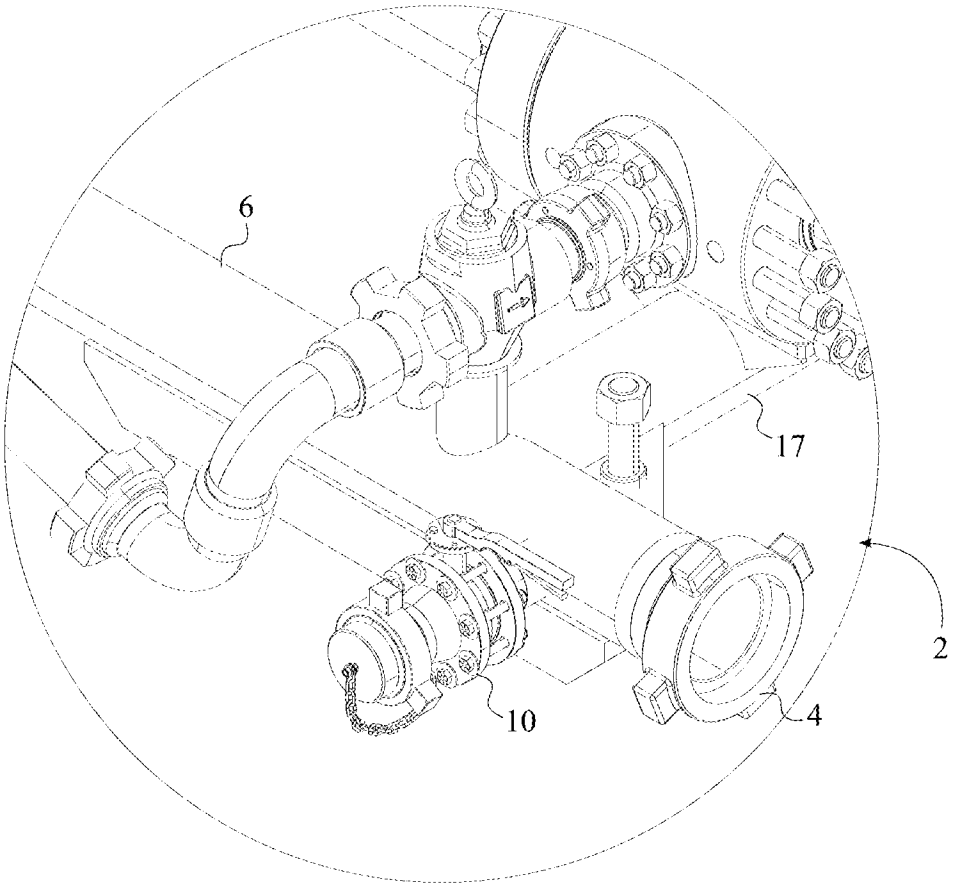
FIG. 7 is a detailed view taken about circle 7 in FIG. 6 showing the right pipe for the fracturing fluid delivering unit.
Figure 8:
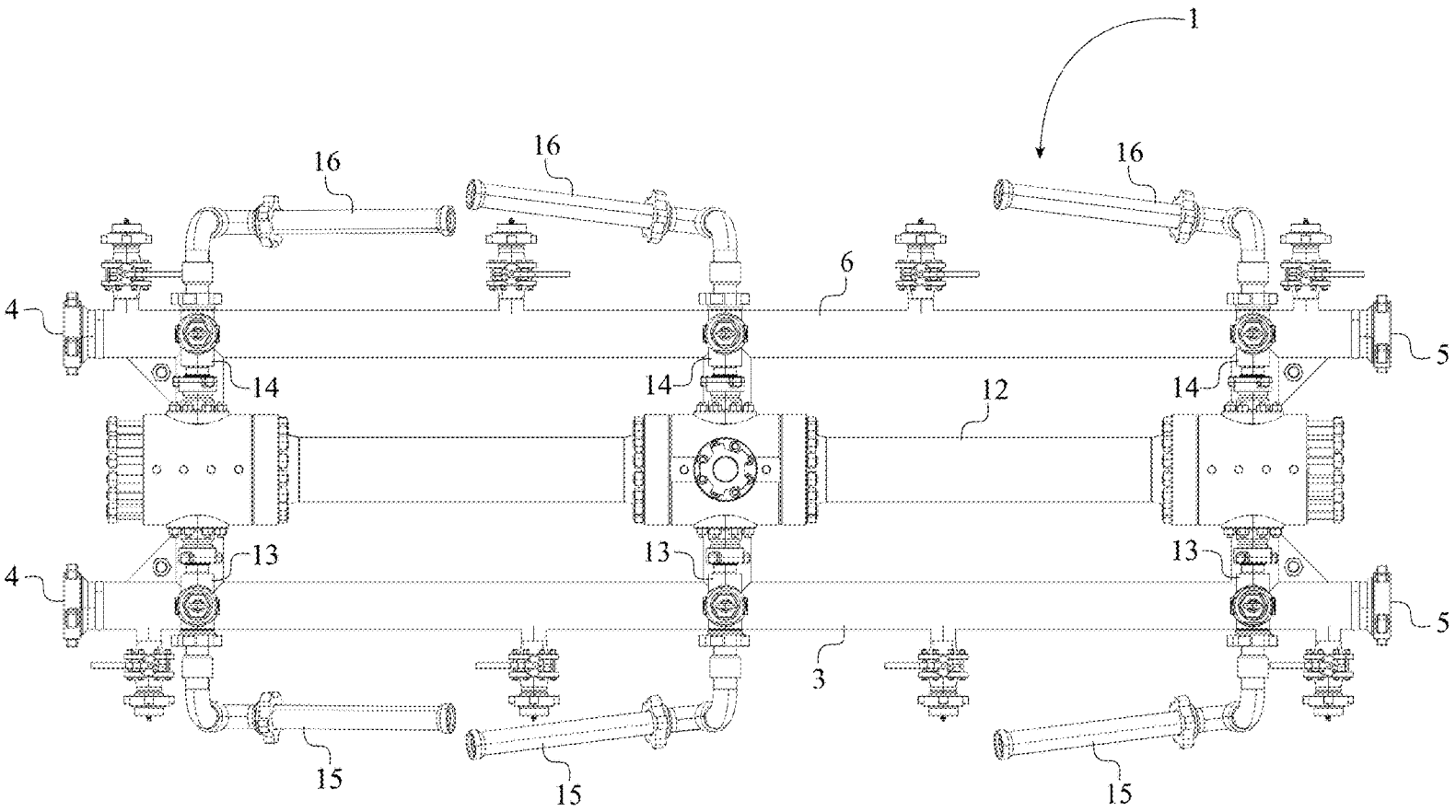
FIG. 8 is a top view of the fracturing fluid delivering unit.

In reference to FIGS. 4 and 6, the left pipe 3 and the right pipe 6 may each comprise a first pipe flange 4 and a second pipe flange 5 thus delineating the two ends of the left pipe 3 and the right pipe 6. More specifically, the first pipe flange 4 of the left pipe 3 is positioned coplanar to the first pipe flange 4 of the right pipe 6. The second pipe flange 5 of the left pipe 3 is positioned coplanar to the second pipe flange 5 of the right pipe 6. Furthermore, the plurality of left outlets 9 is evenly distributed in between the first pipe flange 4 and the second pipe flange 5 of the left pipe 3 so that the first set of trucks can be parked next to each other with sufficient spacing. When the plurality of left outlets 9 is not coupled to the pump trucks, each of the plurality of left outlets 9 is closed with a removable cap to keep out any debris, dust, or any other types of harmful elements. Likewise, the plurality of right outlets 10 is evenly distributed in between the first pipe flange 4 and the second pipe flange 5 of the right pipe 6 so that the second set of trucks can be parked next to each other with sufficient spacing. When the plurality of right outlets 10 is not coupled to the pump trucks, each of the plurality of right outlets 10 is closed with a removable cap to keep out any debris, dust, or any other types of harmful elements. Furthermore, each corresponding removable cap can be tethered to left pipe 3 or the right pipe 6 with a chain or a strap thus preventing the misplacement of the removable cap.

Preferably, each of the plurality of left outlets 9 and each of the plurality of right outlets 10 is equipped or configured with a control valve so that discharging of hydraulic fracturing fluid can be controlled or shut-off during the operation of the present invention.

In order to structurally strengthen the low-pressure flow line assembly 2, the present invention utilizes schedule 120 steel pipes as the left pipe 3 and the right pipe 6. Furthermore, each of the plurality of cross beams 17 is also made from a schedule 120 steel tubular body. As a result, the present invention can be easily lifted and moved via removable attachments to the low-pressure flow line assembly 2 and the plurality of cross beams 17. Furthermore, the low-pressure flow line assembly 2 is configured as a structural base for the high-pressure flow line assembly 11 as the high-pressure flow line assembly 11 is mounted to the low-pressure flow line assembly 2.

In reference to FIGS. 2 and 8 through 10, the high-pressure flow line assembly 11 that injects the pressurized hydraulic fracturing fluid from the multiple pump trucks may comprise a center pipe 12, a plurality of left inlets 13, a plurality of right inlets 14, a plurality of left extensions 15, and a plurality of right extensions 16. More specifically, the center pipe 12 is centrally positioned along the left pipe 3 and the right pipe 6 so that the center pipe 12 can be mounted to the plurality of cross beams 17. The center pipe 12 functions as the main flow line that discharges the pressurized hydraulic fracturing fluid to the wellhead in order to initiate the hydraulic fracturing.

Figure 9:
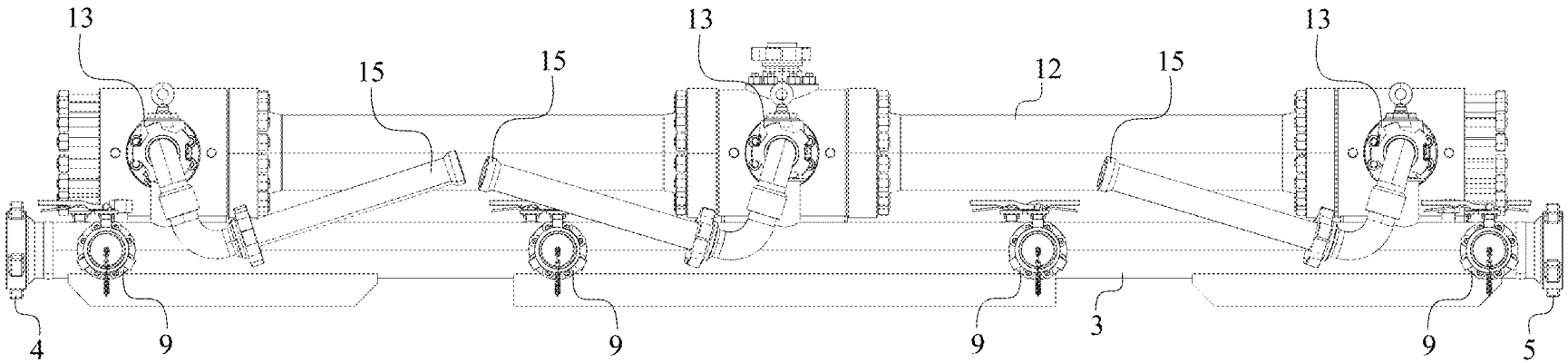
FIG. 9 is a left view of the fracturing fluid delivering unit.

As shown in FIG. 9, the plurality of left inlets 13 is integrated into the center pipe 12. Each of the plurality of left extensions 15 is mounted to a corresponding left inlet from the plurality of left inlets 13. Furthermore, the plurality of left inlets 13 is in fluid communication with the center pipe 12 thus enabling each of the plurality of left extensions 15 to be in fluid communication with the corresponding left inlet from the plurality of left inlets 13. As a result, the first set of pump trucks that is positioned adjacent to the left pipe 3 can continuously supply a steady stream of the pressurized hydraulic fracturing fluid into the center pipe 12 via the plurality of left extensions 15 and the plurality of left inlets 13. In other words, the pressurized hydraulic fracturing fluid from the first set of pump trucks is first discharged into the plurality of left extensions 15, then goes through the plurality of left inlets 13, and into the center pipe 12.

Figure 10:
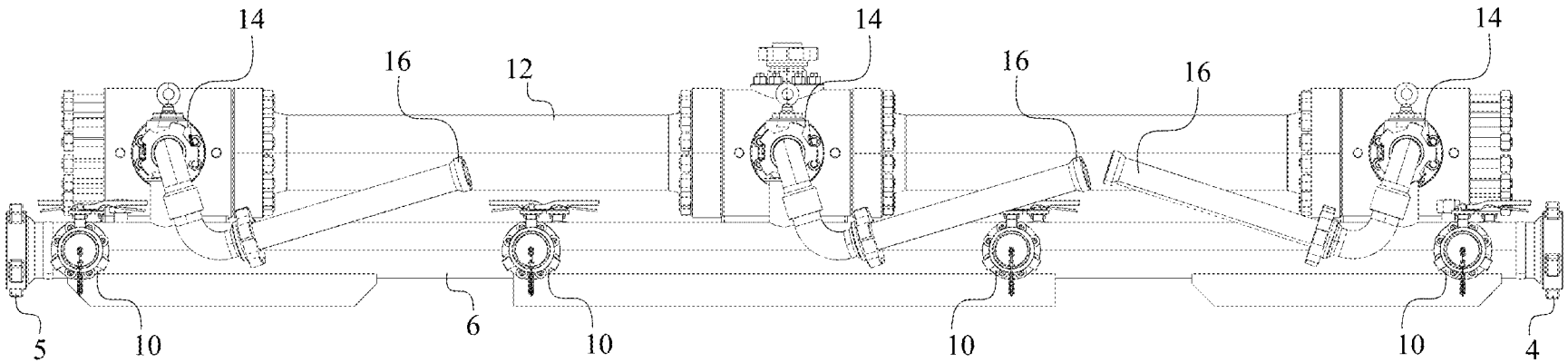
FIG. 10 is a right view of the fracturing fluid delivering unit.

As shown in FIG. 10, the plurality of right inlets 14 is integrated into the center pipe 12. Each of the plurality of right extensions 16 is mounted to a corresponding right inlet from the plurality of right inlets 14. Furthermore, the plurality of right inlets 14 is in fluid communication with the center pipe 12 thus enabling each of the plurality of right extensions 16 to be in fluid communication with the corresponding right inlet from the plurality of right inlets 14. As a result, the second set of pump trucks that is positioned adjacent to the right pipe 6 can continuously supply a steady stream of the pressurized hydraulic fracturing fluid into the center pipe 12 via the plurality of right extensions 16 and the plurality of right inlets 14. In other words, the pressurized hydraulic fracturing fluid from the second set of pump trucks is first discharged into the plurality of right extensions 16, then goes through the plurality of right inlets 14, and into the center pipe 12.

Figure 11:
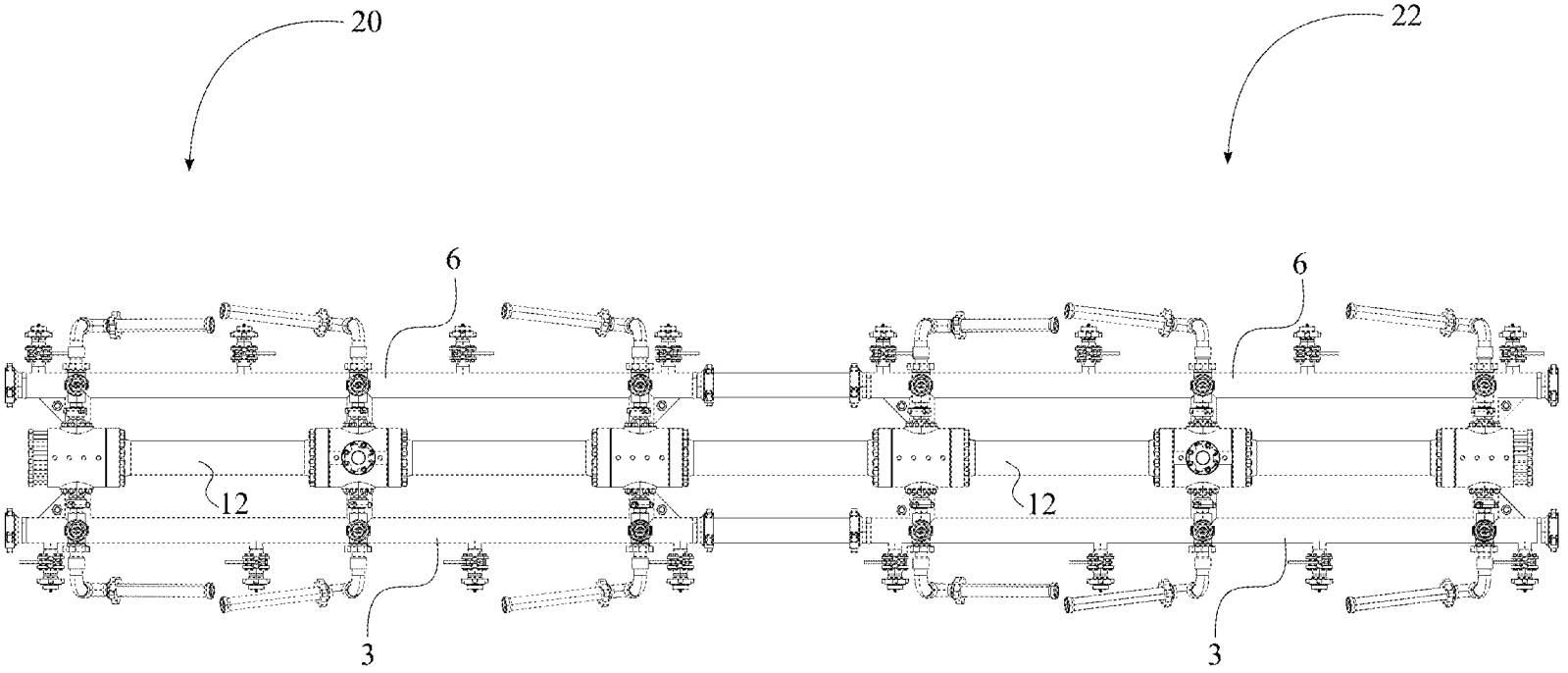
FIG. 11 is a top view of two fracturing fluid delivering units in series.

Depending upon the type of field requirements, the at least one fracturing fluid delivering unit 1 may comprise a first end unit 20 and a second end unit 22 as shown in FIG. 11. During the assembly of the first end unit 20 and the second end unit 22, the left pipe 3 for the low-pressure flow line assembly 2 of the first end unit 20 is concentrically positioned with the left pipe 3 for the low-pressure flow line assembly 2 of the second end unit 22. The right pipe 6 for the low-pressure flow line assembly 2 of the first end unit 20 is concentrically positioned with the right pipe 6 for the low-pressure flow line assembly 2 of the second end unit 22. The left pipe 3 of the first end unit 20 is in fluid communication with the left pipe 3 of the second end unit 22 via a flexible hose or any other type of similar tubing. The right pipe 6 of the first end unit 20 is in fluid communication with the right pipe 6 of the second end unit 22 via a flexible hose or any other type of similar tubing. The center pipe 12 for the high-pressure flow line assembly 11 of the first end unit 20 is concentrically positioned with the center pipe 12 for the high-pressure flow line assembly 11 of the second end unit 22, as the center pipe 12 of the first end unit 20 is in fluid communication with the center pipe 12 of the second end unit 22. Preferably, the center pipe 12 of the first end unit 20 is mounted to the center pipe 12 of the second end unit 22 via nut and bolt fasteners. As a result, the secure connection between the center pipe 12 of the first end unit 20 and the center pipe 12 of the second end unit 22 is collectively configured as a structural member for the low-pressure flow line assembly 2 of the first end unit 20 and the second end unit 22 so that the aforementioned embodiment can be structurally strengthen.

Figure 12:
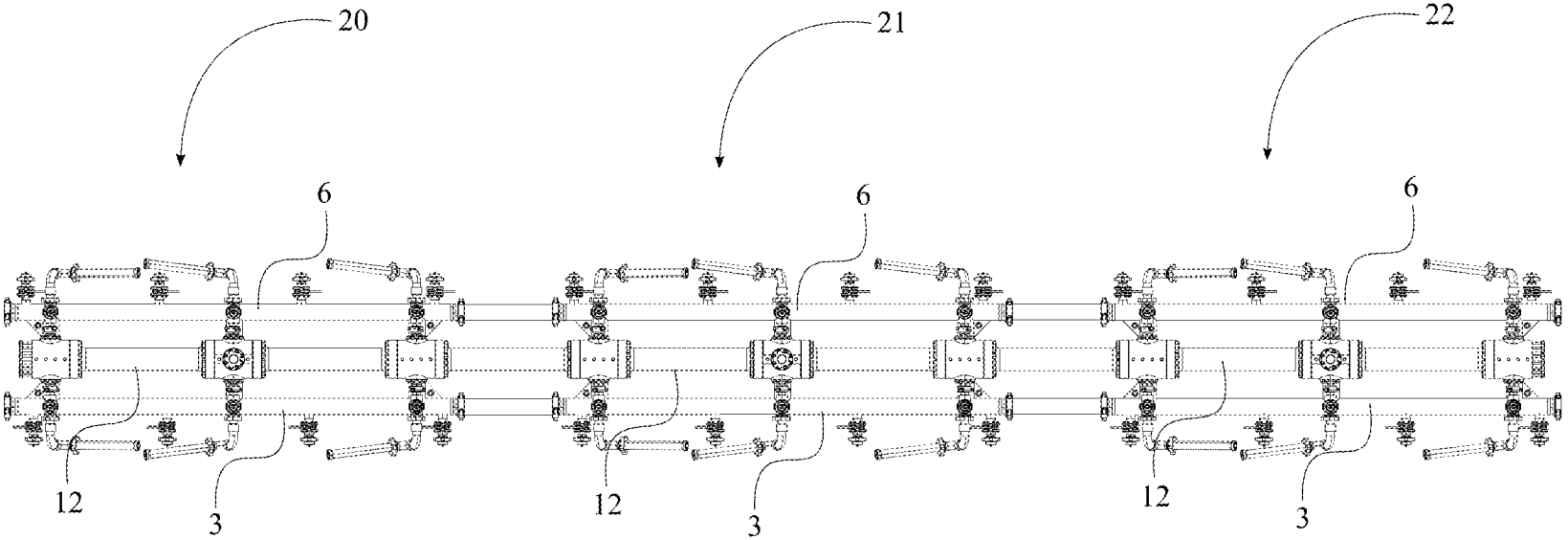
FIG. 12 is a top view of three fracturing fluid delivering units in series.

Depending upon the type of field requirements, the at least one fracturing fluid delivering unit 1 may comprise the first end unit 20, the second end unit 22, and at least one intermediate unit 21 as shown in FIG. 12. During the assembly of the first end unit 20, the intermediate unit 21, and the second end unit 22, the left pipe 3 for the low-pressure flow line assembly 2 of the intermediate unit 21 is concentrically positioned in between the left pipe 3 for the low-pressure flow line assembly 2 of the first end unit 20 and the second end unit 22. Similarly, the right pipe 6 for the low-pressure flow line assembly 2 of the intermediate unit 21 is concentrically positioned in between the right pipe 6 for the low-pressure flow line assembly 2 of the first end unit 20 and the second end unit 22. The left pipe 3 of the first end unit 20 is in fluid communication with the left pipe 3 of the second end unit 22 through the left pipe 3 of the intermediate unit 21. Preferably, a flexible hose or any other type of similar tubing is utilized to complete the fluid-communication pathway of the left pipe 3 for the first end unit 20, the intermediate unit 21, and the second end unit 22. The right pipe 6 of the first end unit 20 is in fluid communication with the right pipe 6 of the second end unit 22 through the right pipe 6 of the intermediate unit 21. Preferably, a flexible hose or any other type of similar tubing is utilized to complete the fluid-communication pathway of the right pipe 6 for the first end unit 20, the intermediate unit 21, and the second end unit 22. The center pipe 12 for the high-pressure flow line assembly 11 of the intermediate unit 21 is concentrically positioned in between the center pipe 12 for the high-pressure flow line assembly 11 of the first end unit 20 and the second end unit 22. Furthermore, the center pipe 12 of the first end unit 20 is in fluid communication with the center pipe 12 of the second end unit 22 through the center pipe 12 of the intermediate unit 21. More specifically, the center pipe 12 of the first end unit 20 is mounted to the center pipe 12 of the intermediate unit 21 via nut and bolt fasteners. Preferably, the center pipe 12 of the second end unit 22 is mounted to the center pipe 12 of the intermediate unit 21 via nut and bolt fasteners, opposite of the center pipe 12 of the first end unit 20. As a result, the center pipe 12 of the first end unit 20, the center pipe 12 of the intermediate unit 21, and the center pipe 12 for the second end unit 22 are collectively configured as a structural member for the low-pressure flow line assembly 2 of the first end unit 20, the intermediate unit 21, and the second end unit 22 so that the aforementioned embodiment can be structurally strengthen.

Figure 13:
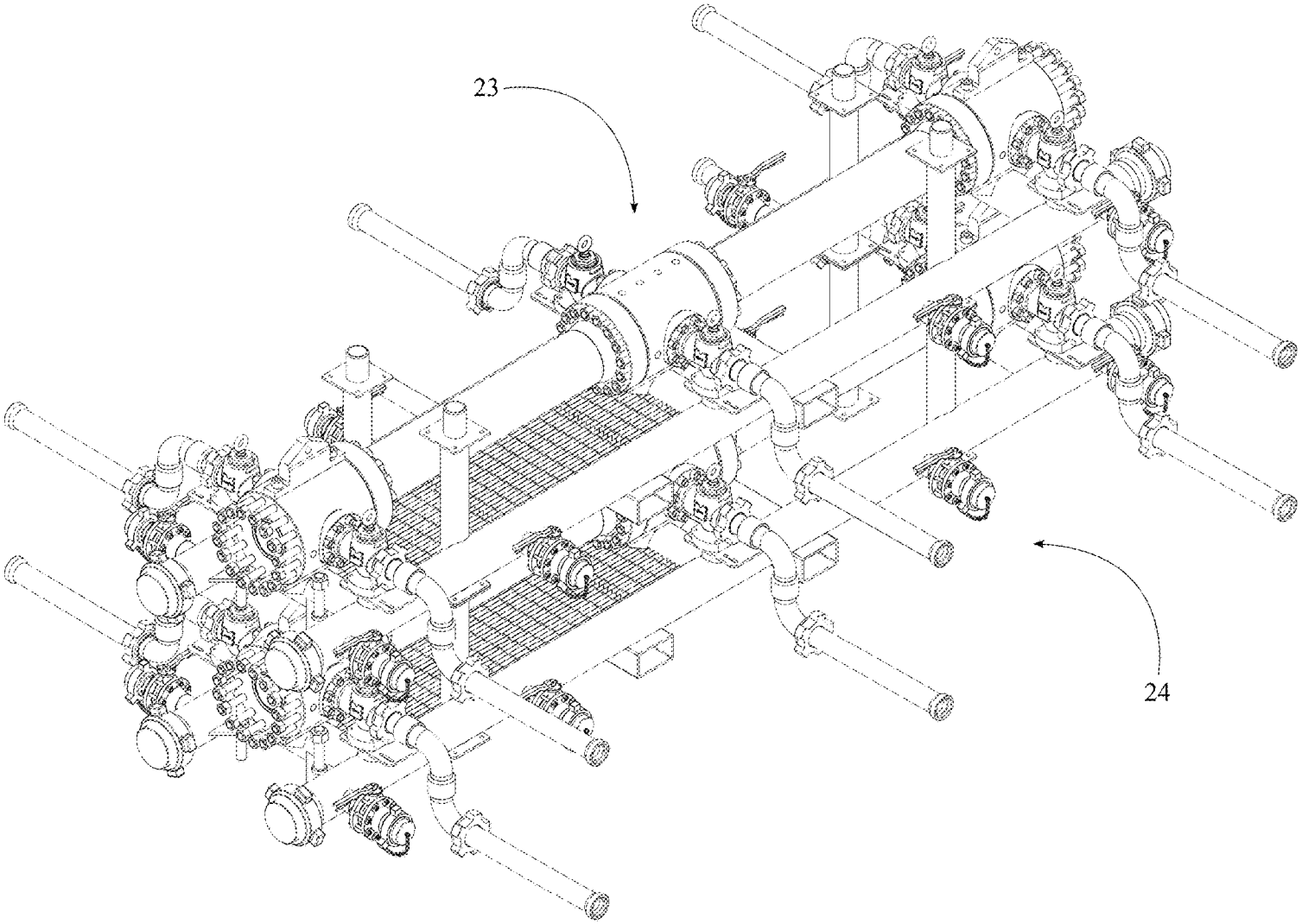
FIG. 13 is a top perspective view of two fracturing fluid delivering units in parallel.

Depending upon the type of field requirements, the at least one fracturing fluid delivering unit 1 may comprise a top unit 23 and a bottom unit 24 as shown in FIG. 13. More specifically, the left pipe 3 for the low-pressure flow line assembly 2 of the top unit 23 is positioned atop and parallel to the left pipe 3 for the low-pressure flow line assembly 2 of the bottom unit 24. The right pipe 6 for the low-pressure flow line assembly 2 of the top unit 23 is positioned atop and parallel to the right pipe 6 for the low-pressure flow line assembly 2 of the bottom unit 24. The center pipe 12 for the high-pressure flow line assembly 11 of the top unit 23 is positioned atop and parallel to the center pipe 12 for the high-pressure flow line assembly 11 of the bottom unit 24. In other words, the top unit 23 is stackable on the bottom unit 24 for field use, transportation, and storage.

Figure 14:
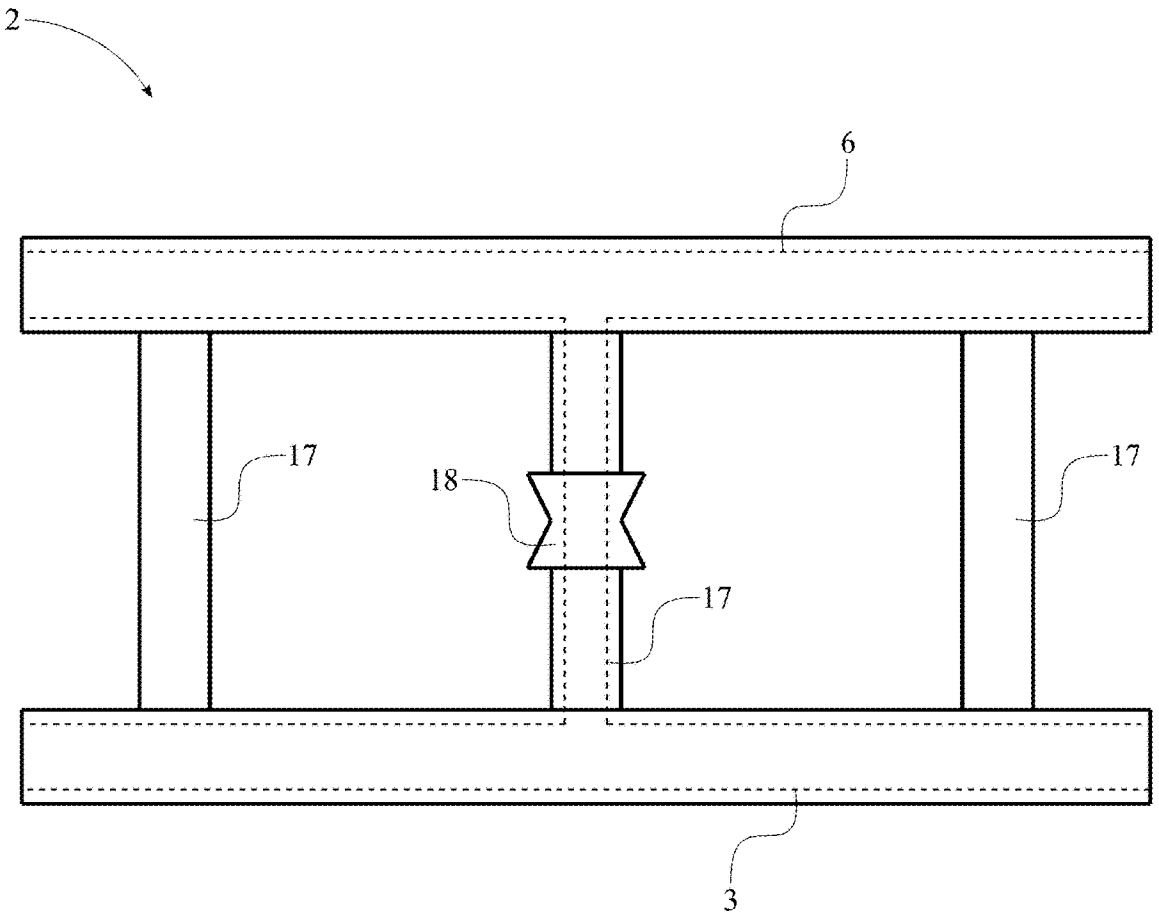
FIG. 14 is a schematic view of the low-pressure flow line assembly for the fracturing fluid delivering unit with a single isolation valve integrated into a cross beam.

As can be seen in FIG. 14, in some embodiments of the present invention, the at least one isolation valve 18 is a single isolation valve, which allows fluid flow between the left pipe 3 and the right pipe 6 at a single exchange point. Thus, the plurality of cross beams 17 comprises a fluid-transfer beam, which is configured with a lumen (i.e., a linear hollowed-out space allowing fluid to flow through this beam). The single isolation valve is operatively integrated into the fluid-transfer beam so that the single isolation valve can be used to control fluid flow through the lumen of the fluid-transfer beam between the left pipe 3 and the right pipe 6.

Figure 15:
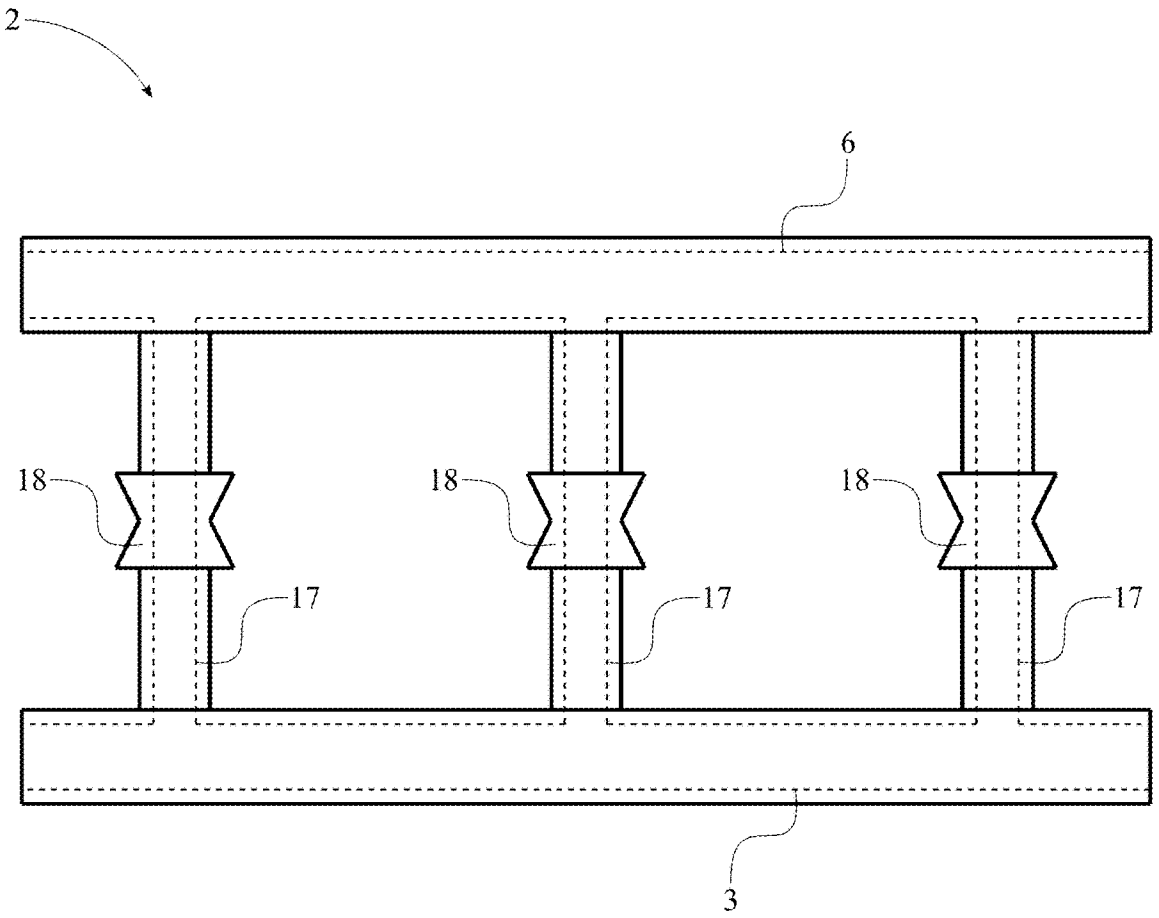
FIG. 15 is a schematic view of the low-pressure flow line assembly for the fracturing fluid delivering unit with multiple isolation valves integrated into different cross beams.

As can be seen in FIG. 15, in some other embodiments of the present invention, the at least one isolation valve 18 is a plurality of isolation valves, which allow fluid flow between the left pipe 3 and the right pipe 6 at multiple exchange points. Thus, the plurality of cross beams 17 comprises a plurality of fluid-transfer beams, each of which is configured with a lumen (i.e., a linear hollowed-out space allowing fluid to flow through each of these beams). Each of the plurality of isolation valves is operatively integrated into a corresponding fluid-transfer beam from the plurality of fluid-transfer beams so that each of the plurality of isolation valves can be used to control fluid flow through the lumen of the corresponding fluid-transfer beam between the left pipe 3 and the right pipe 6.

Figure 16:
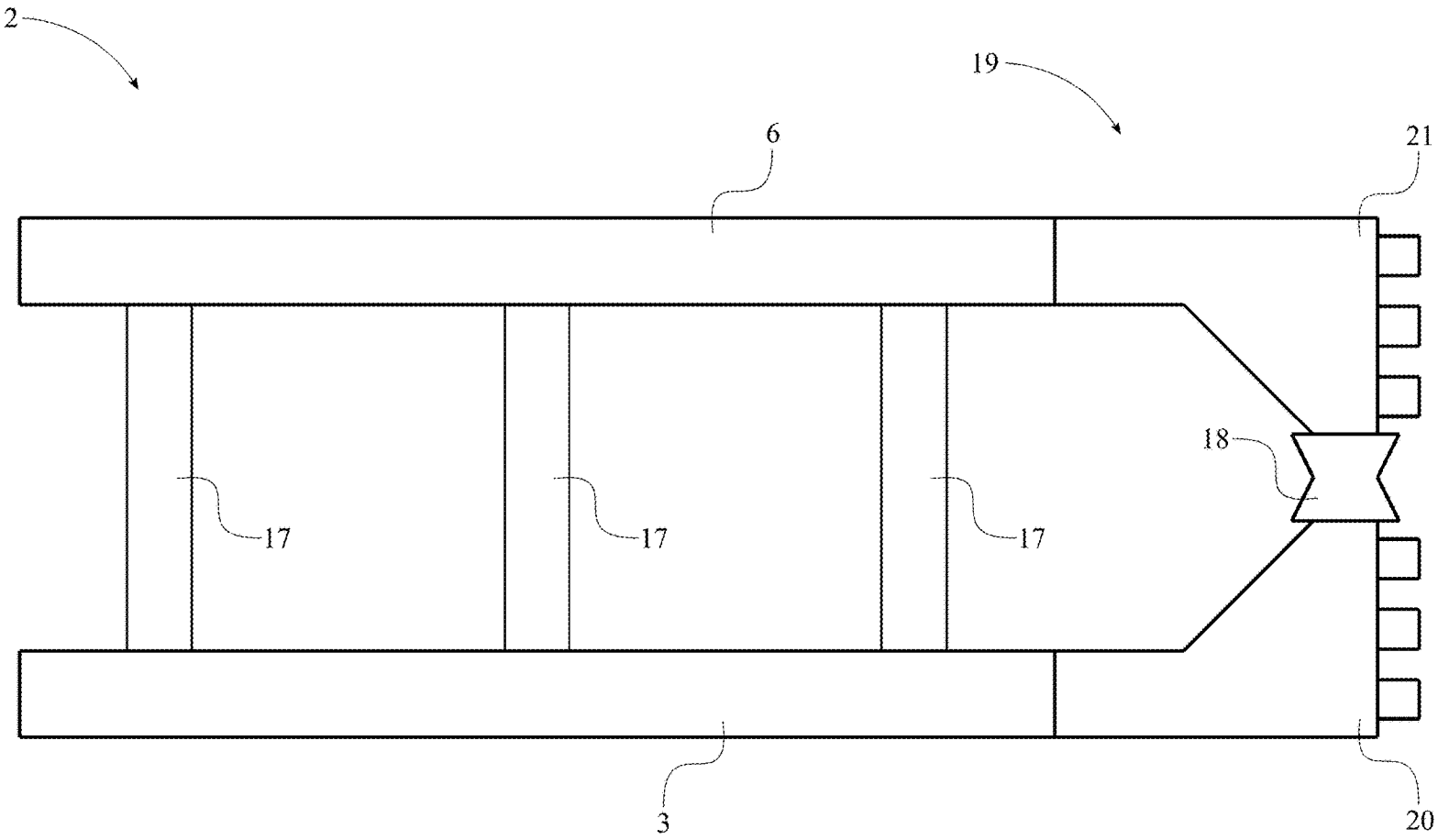
FIG. 16 is a schematic view of the low-pressure flow line assembly for the fracturing fluid delivering unit with a single isolation valve integrated into a split manifold.
Figure 17:
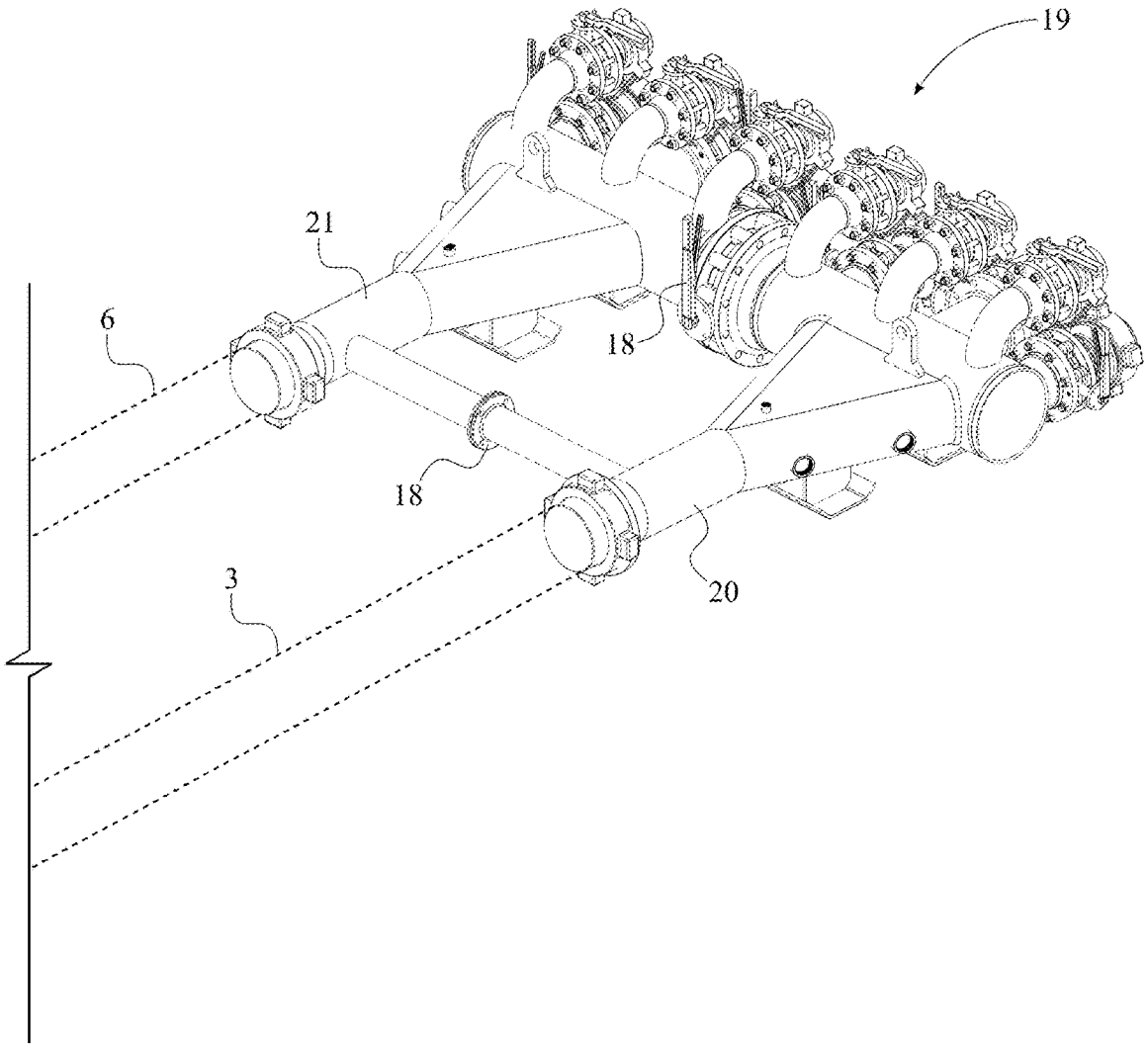
FIG. 17 is a top perspective view of a split manifold for the fracturing fluid delivering unit with an isolation valve.

As can be seen in FIGS. 16 and 17, in some embodiments of the present invention, the at least one fracturing fluid delivering unit 1 further comprising a split manifold 19, which allows a drilling operation to access one pipe (i.e., the left pipe 3 or the right pipe 6) over the other pipe with more truck pumps. Typically, the pipe running a clean fluid requires less truck pumps to operate than the pipe running a dirty fluid. Thus, the split manifold 19 comprises a left manifold portion 20 and a right manifold portion 21, each of which receives a clean fluid or a dirty fluid from their respective pipe. More specifically, the left pipe 3 is in fluid communication with the left manifold portion 20, and the right pipe 6 is in fluid communication with the right manifold portion 21. The left manifold portion 20 and the right manifold portion 21 are in selective fluid communication with each other through the at least one isolation valve 18, which controls fluid flow through the split manifold 19 between the left pipe 3 and the right pipe 6.

Although the invention has been explained in relation to its preferred embodiment, it is to be understood that many other possible modifications and variations can be made without departing from the spirit and scope of the invention as hereinafter claimed.

What is claimed is:

1. A fracturing fluid delivering system comprising:

at least one fracturing fluid delivering unit;

the at least one fracturing fluid delivering unit comprising a low-pressure flow line assembly, a high-pressure flow line assembly, a plurality of cross beams, and at least one isolation valve;

the low-pressure flow line comprising a left pipe and a right pipe;

the plurality of cross beams being evenly spaced along the low-pressure flow line assembly;

the plurality of cross beams being welded onto the low-pressure flow line assembly;

the high-pressure flow line assembly being positioned atop the plurality of cross beams;

the high-pressure flow line assembly being mounted to the plurality of cross beams;

the low-pressure flow line assembly being configured as a structural base for the high-pressure flow line assembly;

the left pipe and the right pipe being mounted parallel and offset from each other; and the left pipe and the right pipe being in selective fluid communication with each other through the at least one isolation valve.

2. The fracturing fluid delivering system as claimed in claim 1 comprising:

the low-pressure flow line assembly further comprising a plurality of left outlets and a plurality of right outlets;

the plurality of cross beams being positioned parallel and offset from each other;

the left pipe being positioned perpendicular to the plurality of cross beams;

the left pipe being terminally welded onto each of the plurality of cross beams;

the right pipe being positioned perpendicular to the plurality of cross beams;

the right pipe being terminally welded onto each of the plurality of cross beams, opposite of the left pipe;

the plurality of left outlets being integrated into the left pipe;

the plurality of right outlets being integrated into the right pipe;

the plurality of left outlets being in fluid communication with the left pipe; and the plurality of right outlets being in fluid communication with the right pipe.

3. The fracturing fluid delivering system as claimed in claim 2 comprising:

the left pipe and the right pipe each comprising a first pipe flange and a second pipe flange;

the first pipe flange of the left pipe being positioned coplanar to the first pipe flange of the right pipe;

the second pipe flange of the left pipe being positioned coplanar to the second pipe flange of the right pipe;

the plurality of left outlets being evenly distributed in between the first pipe flange and the second pipe flange of the left pipe; and the plurality of right outlets being evenly distributed in between the first pipe flange and the second pipe flange of the right pipe.

4. The fracturing fluid delivering system as claimed in claim 2, wherein the left pipe is a steel pipe.

5. The fracturing fluid delivering system as claimed in claim 2, wherein the right pipe is a steel pipe.

6. The fracturing fluid delivering system as claimed in claim 1, wherein each of the plurality of cross beams is a steel tubular body.

7. The fracturing fluid delivering system as claimed in claim 1 comprising:

the high-pressure flow line assembly comprising a center pipe, a plurality of left inlets, a plurality of right inlets, a plurality of left extensions, and a plurality of right extensions;

the center pipe being centrally positioned along the left pipe and the right pipe;

the center pipe being mounted to the plurality of cross beams;

the plurality of left inlets being integrated into the center pipe;

the plurality of right inlets being integrated into the center pipe;

the plurality of left inlets being in fluid communication with the center pipe;

the plurality of right inlets being in fluid communication with the center pipe;

each of the plurality of left extensions being mounted to a corresponding left inlet from the plurality of left inlets;

each of the plurality of right extensions being mounted to a corresponding right inlet from the plurality of right inlets;

each of the plurality of left extensions being in fluid communication with the corresponding left inlet from the plurality of left inlets; and each of the plurality of right extensions being in fluid communication with the corresponding right inlet from the plurality of right inlets.

8. The fracturing fluid delivering system as claimed in claim 1 comprising:

the at least one fracturing fluid delivering unit comprising a first end unit and a second end unit;

the left pipe for the low-pressure flow line assembly of the first end unit being concentrically positioned with the left pipe for the low-pressure flow line assembly of the second end unit;

the right pipe for the low-pressure flow line assembly of the first end unit being concentrically positioned with the right pipe for the low-pressure flow line assembly of the second end unit;

the left pipe of the first end unit being in fluid communication with the left pipe of the second end unit;

the right pipe of the first end unit being in fluid communication with the right pipe of the second end unit;

a center pipe for the high-pressure flow line assembly of the first end unit being concentrically positioned with a center pipe for the high-pressure flow line assembly of the second end unit; and the center pipe of the first end unit being in fluid communication with the center pipe of the second end unit.

9. The fracturing fluid delivering system as claimed in claim 8 comprising:

the center pipe of the first end unit being mounted to the center pipe of the second end unit; and the center pipe of the first end unit and the center pipe of the second end unit being collectively configured as a structural member for the low-pressure flow line assembly of the first end unit and the second end unit.

10. The fracturing fluid delivering system as claimed in claim 1 comprising:

the at least one fracturing fluid delivering unit comprising a first end unit, at least one intermediate unit, and a second end unit;

the left pipe for the low-pressure flow line assembly of the intermediate unit being concentrically positioned in between the left pipe for the low-pressure flow line assembly of the first end unit and the second end unit;

the right pipe for the low-pressure flow line assembly of the intermediate unit being concentrically positioned in between the right pipe for the low-pressure flow line assembly of the first end unit and the second end unit;

the left pipe of the first end unit being in fluid communication with the left pipe of the second end unit through the left pipe of the intermediate unit;

the right pipe of the first end unit being in fluid communication with the right pipe of the second end unit through the right pipe of the intermediate unit;

a center pipe for the high-pressure flow line assembly of the intermediate unit being concentrically positioned in between a center pipe for the high-pressure flow line assembly of the first end unit and the second end unit; and the center pipe of the first end unit being in fluid communication with the center pipe of the second end unit through the center pipe of the intermediate unit.

11. The fracturing fluid delivering system as claimed in claim 10 comprising:

the center pipe of the first end unit being mounted to the center pipe of the intermediate unit;

the center pipe of the second end unit being mounted to the center pipe of the intermediate unit, opposite of the center pipe of the first end unit; and the center pipe of the first end unit, the center pipe of the intermediate unit, and the center pipe for the second end unit being collectively configured as a structural member for the low-pressure flow line assembly of the first end unit, the intermediate unit, and the second end unit.

12. The fracturing fluid delivering system as claimed in claim 1 comprising:

the at least one fracturing fluid delivering unit comprising a top unit and a bottom unit;

the left pipe for the low-pressure flow line assembly of the top unit being positioned atop the left pipe for the low-pressure flow line assembly of the bottom unit;

the right pipe for the low-pressure flow line assembly of the top unit being positioned atop the right pipe for the low-pressure flow line assembly of the bottom unit; and a center pipe for the high-pressure flow line assembly of the top unit being positioned atop a center pipe for the high-pressure flow line assembly of the bottom unit.

13. The fracturing fluid delivering system as claimed in claim 12, wherein the top unit being stackable on the bottom unit for field use, transportation, and storage.

14. The fracturing fluid delivering system as claimed in claim 1 comprising:

the plurality of cross beams comprising a fluid-transfer beam;

the at least one isolation valve being a single isolation valve;

the fluid-transfer beam being configured with a lumen; and the single isolation valve being operatively integrated into the fluid-transfer beam, wherein the single isolation valve is used to control fluid flow through the lumen of the fluid-transfer beam between the left pipe and the right pipe.

15. The fracturing fluid delivering system as claimed in claim 1 comprising:

the plurality of cross beams comprising a plurality of fluid-transfer beams;

the at least one isolation valve being a plurality of isolation valves;

each of the plurality of fluid-transfer beams being configured with a lumen; and each of the plurality of isolation valves being operatively integrated into a corresponding fluid-transfer beam from the plurality of fluid-transfer beams, wherein each of the plurality of isolation valves is used to control fluid flow through the lumen of the corresponding fluid-transfer beam between the left pipe and the right pipe.

16. The fracturing fluid delivering system as claimed in claim 1 comprising:

the at least one fracturing fluid delivering unit further comprising a split manifold;

the split manifold comprising a left manifold portion and a right manifold portion;

the left pipe being in fluid communication with the left manifold portion;

the right pipe being in fluid communication with the right manifold portion; and the left manifold portion and the right manifold portion being in selective fluid communication with each other through the at least one isolation valve.

* * * * *